US006145587A

United States Patent [19]

Hanafusa

[11] Patent Number: 6,145,587

[45] **Date of Patent: *Nov. 14, 2000**

[54] EVAPORATOR

[75] Inventor: Tatsuya Hanafusa, Tochigi, Japan

[73] Assignee: Showa Aluminum Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/158,067

[22] Filed: Sep. 22, 1998

[30] Foreign Application Priority Data

Sep. 24, 1997 [JP] Japan ..... 9-258192

[51] Int. Cl.[7] ..... F28D 9/00

[52] U.S. Cl. ..... 165/153; 165/174

[58] Field of Search ..... 165/153, 174

[56] References Cited

U.S. PATENT DOCUMENTS 4,217,953 8/1980 Sonoda et al. .
4,274,482 6/1981 Sonoda .
4,712,612 12/1987 Okamoto et al. ..... 165/146
5,431,217 7/1995 Kadle et al. ..... 165/153

FOREIGN PATENT DOCUMENTS 0 601 622 6/1994 European Pat. Off. .
0 727 625 8/1996 European Pat. Off. .
3-247993 11/1991 Japan ..... 165/174

*Primary Examiner*—Allen Flanigan
*Attorney, Agent, or Firm*—Armstrong, Westerman, Hattori, McLeland & Naughton

[57] ABSTRACT

An evaporator comprises front and rear header portions, and U-shaped flat tubular portions arranged in parallel and each connected at opposite ends thereof to the header portions. Each of the header portions is provided with a partition for blocking a refrigerant flowing inside thereof and directing the refrigerant toward some of the flat tubular portions to thereby form a refrigerant channel comprising a plurality of paths each turned by the partition. The rear header portion of the final path is provided with a refrigerant dividing wall having refrigerant apertures for passing therethrough a portion of the refrigerant flowing in from the path immediately upstream from the final path, with the remaining portion of the refrigerant blocked by the wall and directed toward some of the flat tubular portions.

8 Claims, 10 Drawing Sheets

EVAPORATOR

BACKGROUND OF THE INVENTION

The present invention relates to evaporators for use in air conditioners for motor vehicles.

Evaporators for use in motor vehicle air conditioners and the like are already known which comprise first and second header portions arranged in parallel, and flat tubular portions arranged in parallel and each connected at opposite ends thereof to the header portions, each of the header portions being provided with a partition for blocking a refrigerant flowing inside thereof and directing the refrigerant toward some of the flat tubular portions to thereby form a refrigerant channel comprising a first path, at least one intermediate path and a final path.

With the conventional evaporator described above, the number of paths, i.e., the number of blocking partitions, is altered to obtain optimally divided flows of the refrigerant. With decreases in the width of evaporators in recent years, however, the refrigerant passing apertures are reduced in area, and the refrigerant is moved from path to path at an increased rate, impairing the division of the refrigerant in a downstream path (especially in the final path) and permitting the refrigerant to unevenly pass through the flat tubular portions providing this path, with an increased amount of the refrigerant flowing through the flat tubular portion at the downstream extremity. This imposes a limitation on the improvement of the cooling ability.

SUMMARY OF THE INVENTION

An object of the present invention is to provide an evaporator wherein the division of the refrigerant into separate flows in a downstream path is optimized by a method other than varying the number of paths so as to give high cooling ability to the evaporator.

The present invention provides an evaporator which comprises first and second header portions arranged in parallel, and flat tubular portions arranged in parallel and each connected at opposite ends thereof to the header portions, each of the header portions being provided with a partition for blocking a refrigerant flowing inside thereof and directing the refrigerant toward some of the flat tubular portions to thereby form a refrigerant channel comprising a first path, at least one intermediate path and a final path, the evaporator being characterized in that at least one of the header portions is provided with at least one refrigerant dividing wall having at least one refrigerant aperture for passing therethrough a portion of the refrigerant flowing from one of the paths into the path downstream from said one path, with the remaining portion of the refrigerant blocked by the wall and directed toward some of the flat tubular portions.

In the case where one refrigerant dividing wall is provided in the first header portion of the evaporator of the invention, the refrigerant flowing out from one path into the first header portion of the path immediately downstream from the former path partly passes through the refrigerant aperture of the dividing wall to reach the downstream part of the first header portion of the downstream path and thereafter flows through the flat tubular portions in communication with the downstream part into the downstream part of the second header portion of the downstream path. On the other hand, the portion of the refrigerant blocked by the dividing wall flows through the flat tubular portions in the upstream part of the downstream path into the upstream part of the second header portion of the downstream path. The portions of the refrigerant divided by the wall join together inside the second header portion, and the combined refrigerant flows out of the second header portion into the path which is positioned further downstream. Accordingly, a greater quantity of refrigerant flows through the flat tubular portions in the upstream part of the downstream path than when the evaporator has no refrigerant dividing wall, consequently giving a uniform distribution of refrigerant temperatures throughout the entire evaporator to result in improved cooling ability. The same result is achieved in the case where one refrigerant dividing wall is provided in the second header portion and in the case where one refrigerant dividing wall is provided in each of the header portions. Thus, the evaporator exhibits a uniform distribution of refrigerant temperatures in its entirety and improved cooling ability unlike evaporators having no refrigerant dividing wall.

Preferably, the final path causes the refrigerant to turn at a closed end of the first header portion and to flow out of an end of the second header portion which end has a refrigerant outlet, and the refrigerant dividing wall is singly provided in the first header portion of the final path. In this case, the refrigerant flowing into the first header portion of the final path partly passes through the refrigerant aperture of the dividing wall to reach the downstream part of the first header portion of the final path and thereafter flows through the flat tubular portions in communication with the downstream part into the downstream part of the second header portion of the final path. On the other hand, the portion of the refrigerant blocked by the dividing wall flows through the flat tubular portions in the upstream part of the final path into the upstream part of the second header portion of the final path. The portions of the refrigerant divided by the wall join together inside the second header portion, and the combined refrigerant flows out of the refrigerant outlet of the second header portion. This ensures a uniform distribution of refrigerant temperatures in the final path which is very likely to impair the division of the refrigerant into separate flows, effectively attaining an improvement in the cooling ability.

Preferably, the refrigerant dividing wall has one to six refrigerant apertures. If the number of apertures is greater than six, the wall requires much labor for machining, while a uniform distribution of refrigerant temperatures will not be achieved effectively.

Preferably, the refrigerant apertures are arranged in a plurality of pairs, and each pair of refrigerant apertures are positioned symmetrically. This arrangement obviates occurrence of an uneven flow inside the header portion, consequently eliminating the disadvantage resulting from the provision of the refrigerant apertures.

The refrigerant apertures are circular and have a diameter preferably of 2.5 to 4.0 mm.

More preferably, the diameter of the refrigerant apertures is 3.0 to 3.5 mm.

DESCRIPTION OF THE PREFERRED EMBODIMENTS

Embodiments of the invention will be described with reference to the drawings.

Figure 1:
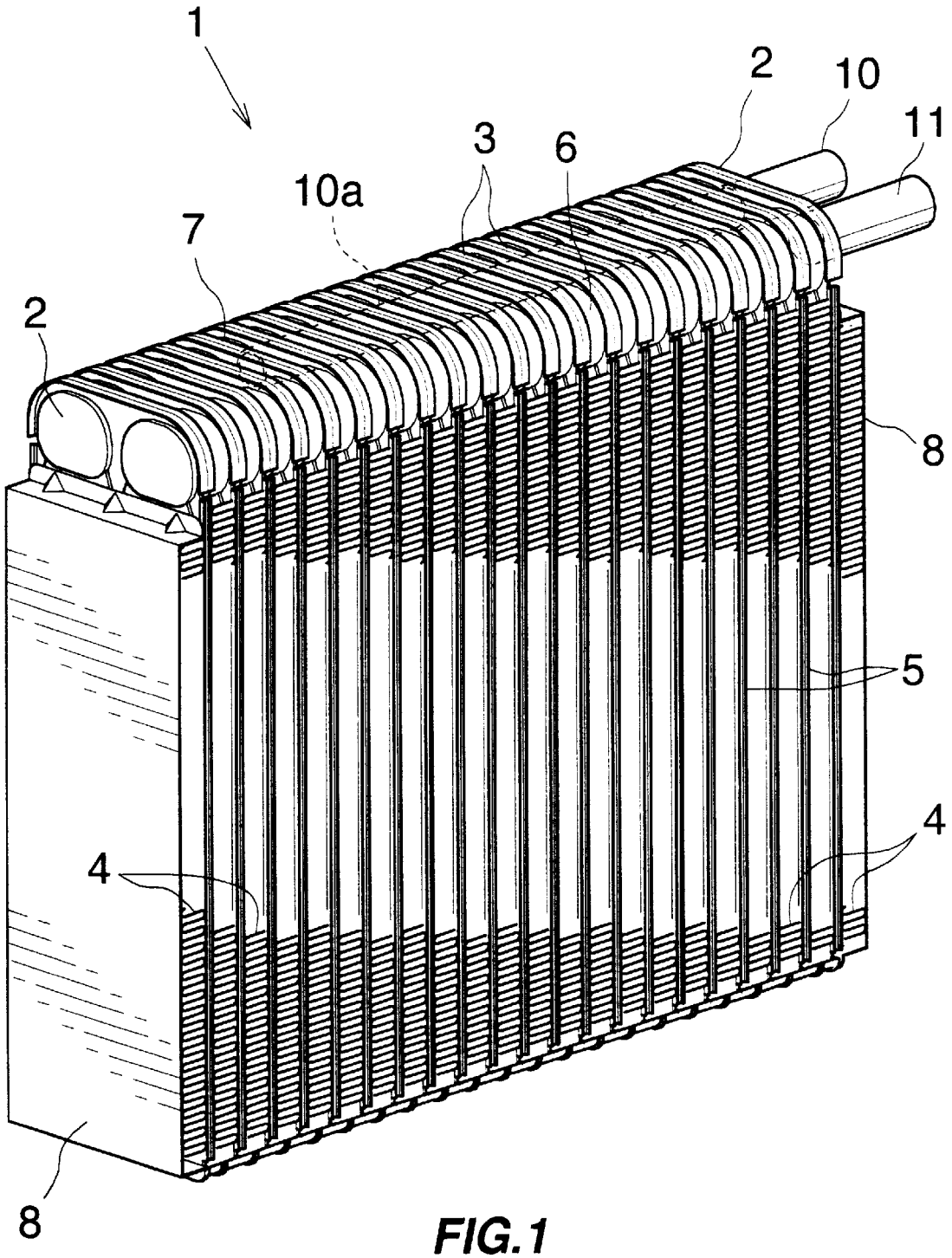
FIG. 1 is a perspective view showing the appearance of an evaporator embodying the invention.
Figure 2:
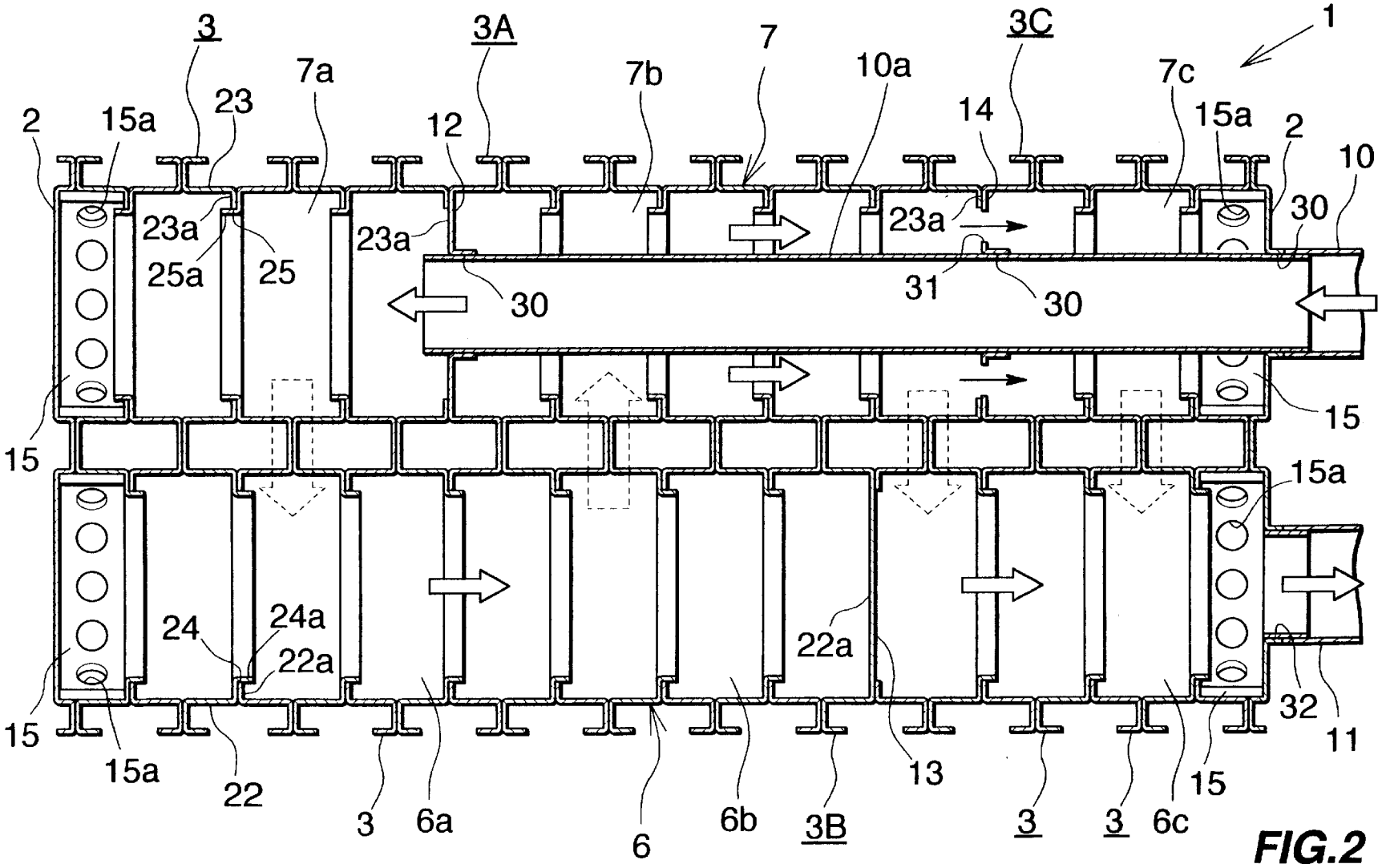
FIG. 2 is a fragmentary view in horizontal section showing the interior of header portions of the evaporator.

The terms "front," "rear," "left" and "right" are used based on FIG. 2; the upper side of the drawing will be referred to as the "rear," the lower side thereof as the "front," and the left-hand side and right-hand side thereof as "left" and "right," respectively.

An evaporator 1 embodying the invention is made of aluminum (including an aluminum alloy) and comprises U-shaped flat tubular portions 5 arranged in parallel, and front and rear header portions 6, 7, these portions being formed by fitting together intermediate plates 2, 3, 3A, 3B, 3C as will be described later. Corrugated fins 4 are interposed between each pair of adjacent flat tubular portions 5. A side plate 8 is fitted to each of opposite outer sides of the assembly of intermediate plates 2, 3, 3A, 3B, 3C fitted together. Corrugated fins 4 are provided also between the side plate 8 and the tubular portions 5 adjacent thereto. Connected to the right end of the rear header portion 7 is a refrigerant inlet pipe 10 having an inner pipe portion 10*a*. A refrigerant outlet pipe 11 is joined to the right end of the front header portion 6.

With reference to FIG. 2, the intermediate plates 2, 3, 3A, 3B, 3C are end intermediate plates 2 arranged at the left and right ends of the evaporator 1, a rear header partitioning intermediate plate 3A positioned at a distance of about ⅓ of the length of the evaporator rightward from the left end, a front header partitioning intermediate plate 3B disposed at a distance of about ⅓ of the length leftward from the right end, a refrigerant dividing wall forming intermediate plate 3C positioned at a distance of about ⅙ of the length leftward from the right end, and the remaining plates, i.e., standard intermediate plates 3. At each of the left and right ends of the evaporator 1, the standard intermediate plate 3 and the end intermediate plate 2 are paired. The number of plates shown in FIG. 2 is less than actually for the sake of convenience. In actuality, the evaporator has, for example, 21 pairs of plates in total: one of the seventh pair of plates from the left end may serve as the rear header partitioning intermediate plate 3A, one of the seventh pair of plates from the right end may serve as the front header partitioning intermediate plate 3B, and one of the fourth pair of plates from the right end may serve as the refrigerant dividing wall forming intermediate plate 3C.

Figure 4:
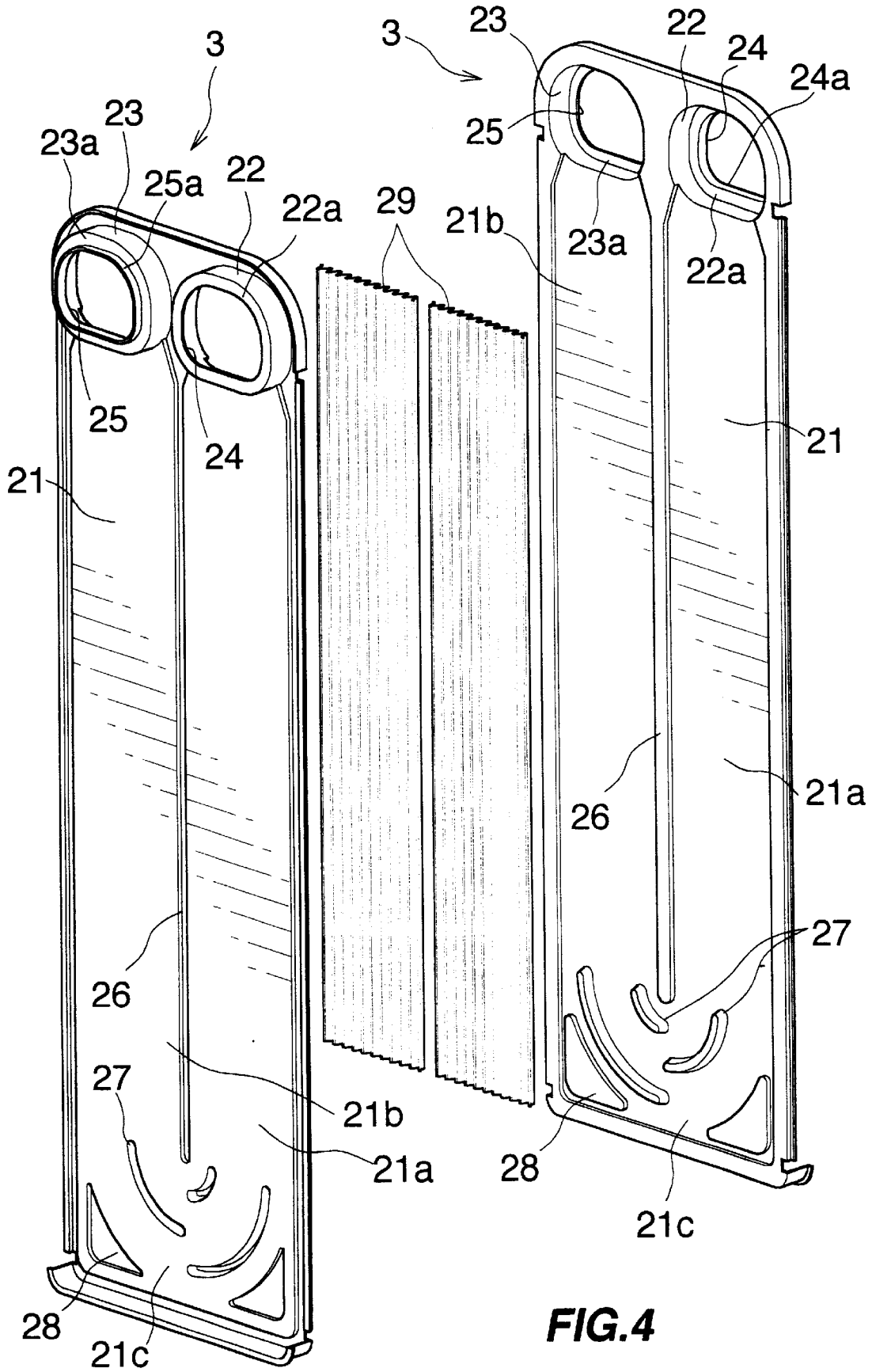
FIG. 4 is a perspective view showing a pair of standard intermediate plates constituting the evaporator.
Figure 5:
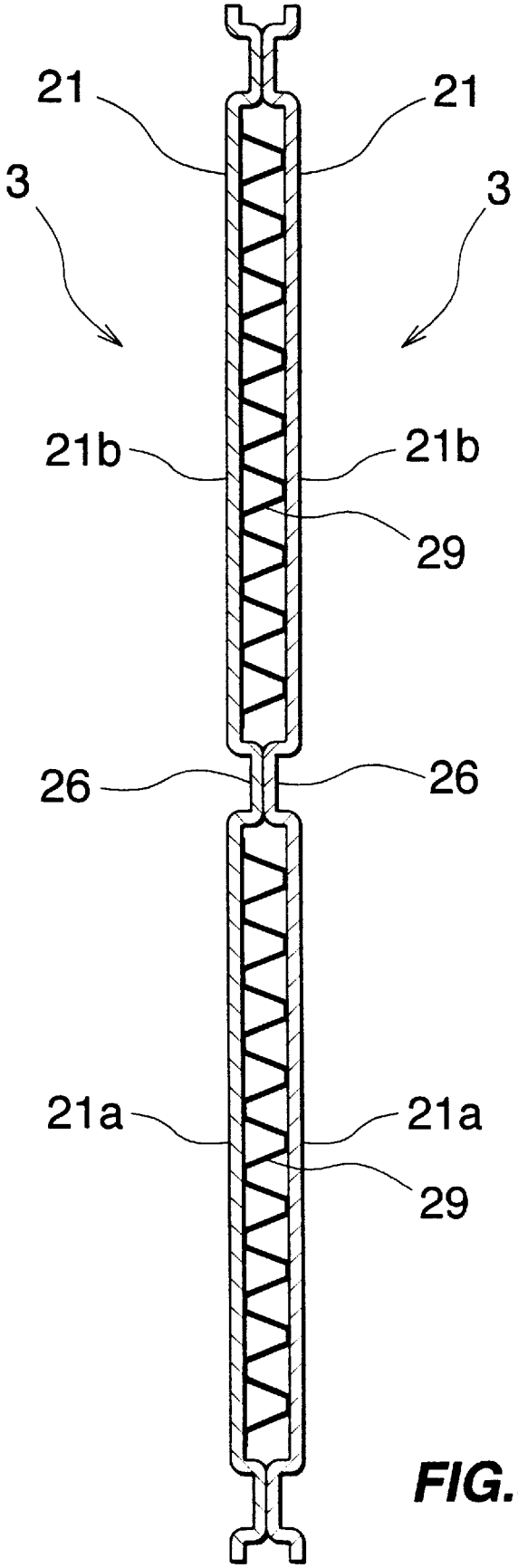
FIG. 5 is a view in horizontal section of a flat tubular portion of the evaporator.

FIG. 4 shows one pair of standard intermediate plates 3. With reference to this drawing, the intermediate plate 3 comprises a generally U-shaped flat tube forming recessed portion 21 including a front vertical portion 21*a*, a rear vertical portion 21*b* and a horizontal portion 21 interconnecting these portions 21*a*, 21*b*; and front and rear header forming recessed portions 22, 23 integral with the upper ends of the respective front and rear vertical portions 21*a*, 21*b* and having a greater depth than the recessed portion 21. Two refrigerant apertures 24, 25, each in the form of a circle elongated transversely of the evaporator, are formed in the standard plate 3, respectively in the bottom walls 22*a*, 23*a* of the header forming recessed portions 22, 23. The tube forming recessed portion 21 of the intermediate plate 3 is centrally formed with a vertical long ridge 26 extending from the upper end of the recessed portion 21 to a position close to the lower end thereof for providing a U-shaped refrigerant channel. With the illustrated pair of standard plates 3 fitted to each other, the recessed portions 21 thereof provide one flat tubular portion 5. Inner fin members 29 having parallel vertical passages are interposed between the bottom walls of front and rear vertical portions 21*a*, 21*b* of the tube forming recessed portions 21 of the pair of intermediate plates 3, whereby vertical parallel passageways are formed in the flat tubular portion 5 as seen in FIG. 5. The bottom wall of horizontal portion 21*c* of the tube forming recessed portion 21 is provided with a quadrant protrusion 27 for forming a semicircular arc turn portion for holding the front vertical portion of the flat tubular portion 5 in communication with the rear vertical portion thereof, and generally triangular protrusions 28 arranged at the front and rear sides of lower part of the horizontal portion 21*c* for reinforcing the corresponding corners of the plate 3 and permitting the refrigerant to flow through the turn portion smoothly. A projecting edge 25*a* is formed by burring on the peripheral part around the refrigerant aperture 25 of the rear header forming recessed portion 23 of the plate 3 at left in FIG. 4. A projecting edge 24*a* is formed by burring on the peripheral part around the refrigerant aperture 24 of the front header forming recessed portion 22 of the plate 3 at right in FIG. 4 (see FIG. 2). These projecting edges 24*a*, 25*a* are fitted in the refrigerant apertures 24, 25 of the header forming recessed portions 22, 23 adjacent thereto as seen in FIG. 2, whereby the intermediate plates 3 concerned are reliably positioned in place relative to one another. The inner fin member 29 may be replaced by a plurality of ridges formed on the bottom wall of each of the front and rear vertical portions 21*a*, 21*b* of the tube forming recessed portion 21 so as to form straight small passageways in the tubular portion 5.

Figure 6:
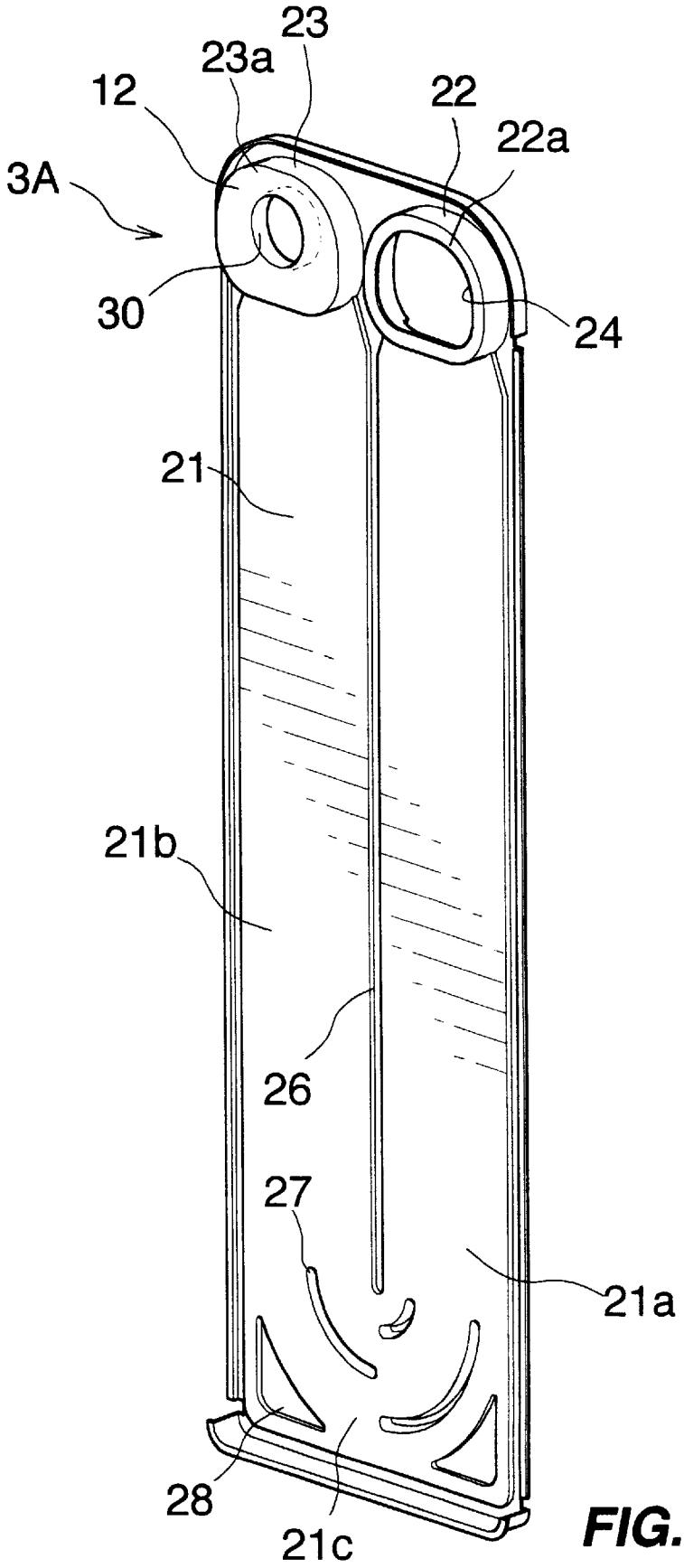
FIG. 6 is a perspective view of a rear header partitioning intermediate plate constituting the evaporator.

FIG. 6 shows the rear header partitioning intermediate plate 3A. With reference to the drawing, the intermediate plate 3A has a front header forming recessed portion 22 which is formed in its bottom wall 22*a* with a refrigerant aperture 24 generally in the form of a circle elongated transversely of the evaporator, and a rear header forming recessed portion 23 which is formed in its bottom wall 23*a* with a through hole 30 having a diameter equal to the outside diameter of the inner pipe portion 10*a* of the refrigerant inlet pipe 10. With the left end of the inner pipe portion 10*a* inserted through the hole 30, the bottom wall 23*a* of the recessed portion 23 serves as a rear header partition 12. The bottom wall edge defining the through hole 30 is burred so as to give an increased area of contact with the pipe portion 10*a*. The intermediate plate 3A has the same construction as the standard intermediate plate 3 with the exception of the above feature, and like parts are designated by like reference numerals and will not be described repeatedly.

Figure 7:
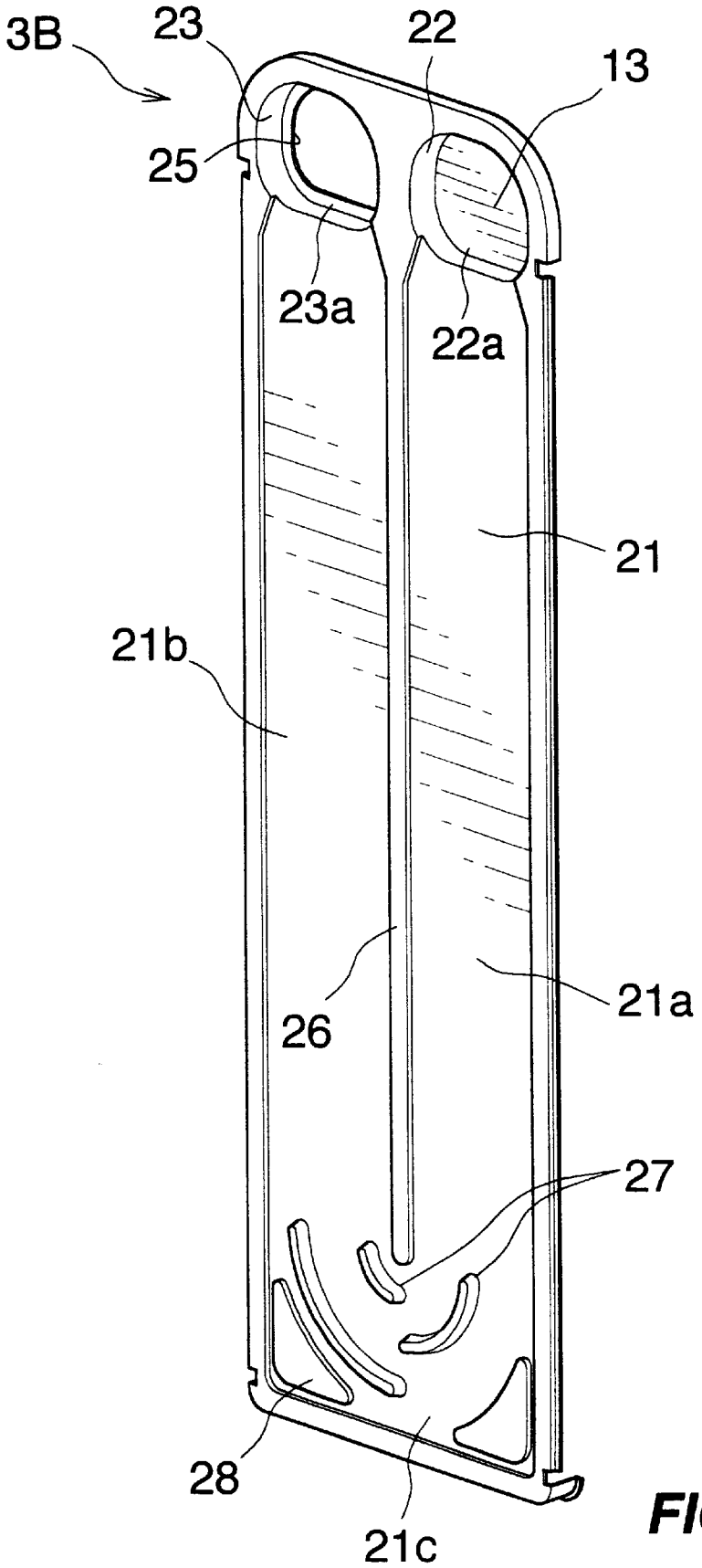
FIG. 7 is a perspective view of a front header partitioning intermediate plate constituting the evaporator.

FIG. 7 shows the front header partitioning intermediate plate 3C. With reference to the drawing, the intermediate plate 3B has a rear header forming recessed portion 23 which is formed in its bottom wall 23*a* with a refrigerant aperture 25 generally in the form of a circle elongated transversely of the evaporator, and a front header forming recessed portion 22 which is formed with no refrigerant aperture in its bottom wall 22*a*. The bottom wall 22*a* having no aperture serves as a front header partition 13. The intermediate plate 3B has the same construction as the standard intermediate plate 3 with the exception of the above feature, and like parts are designated by like reference numerals and will not be described repeatedly.

Figure 8:
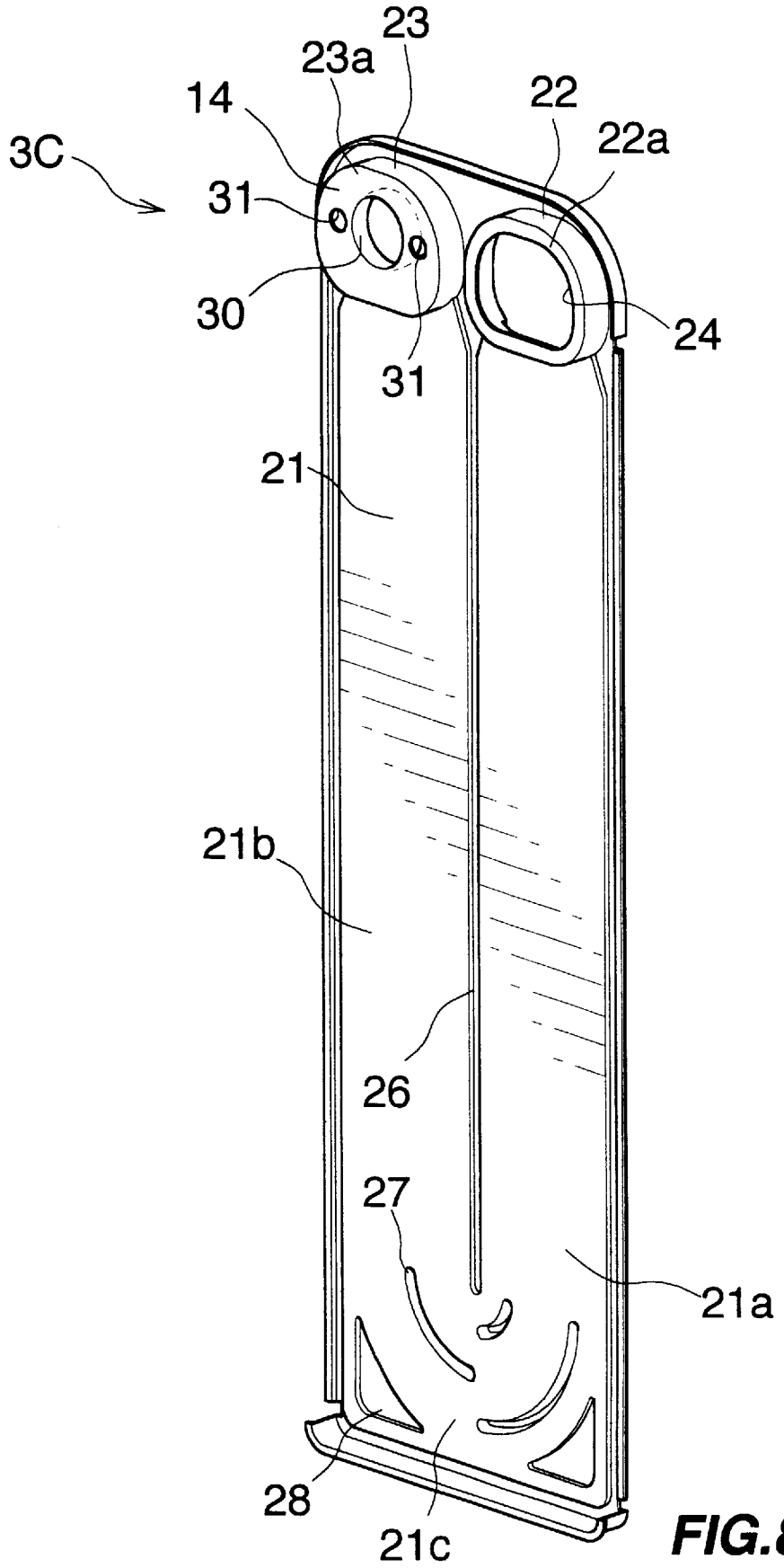
FIG. 8 is a perspective view of a refrigerant dividing wall forming intermediate plate constituting the evaporator.

FIG. 8 shows the refrigerant dividing wall forming intermediate plate 3C. With reference to the drawing, the intermediate plate 3C has a front header forming recessed portion 22 which is formed in its bottom wall 22*a* with a refrigerant aperture 24 generally in the form of a circle elongated transversely of the evaporator, and a rear header forming recessed portion 23 which is formed in its bottom wall 23*a* with a through hole 30 having a diameter equal to the outside diameter of the inner pipe portion 10*a* of the refrigerant inlet pipe 10 and with two refrigerant apertures 31 respectively at the front and rear sides of the hole 30. These apertures 31 are small, so that when the inner pipe portion 10*a* is inserted through the hole 30, the refrigerant flowing rightward in the rear header portion 7 partly passes through the apertures 31 as indicated by solid arrows in FIG. 2, while the remaining portion of the refrigerant is blocked by the bottom plate 23*a* and directed toward the U-shaped flat tubular portion 5 as indicated by an arrow of broken line. Thus the bottom wall 23*a*, having the apertures 31, of the rear header forming recessed portion 23 serves as a refrigerant dividing wall 14.

Figure 9:
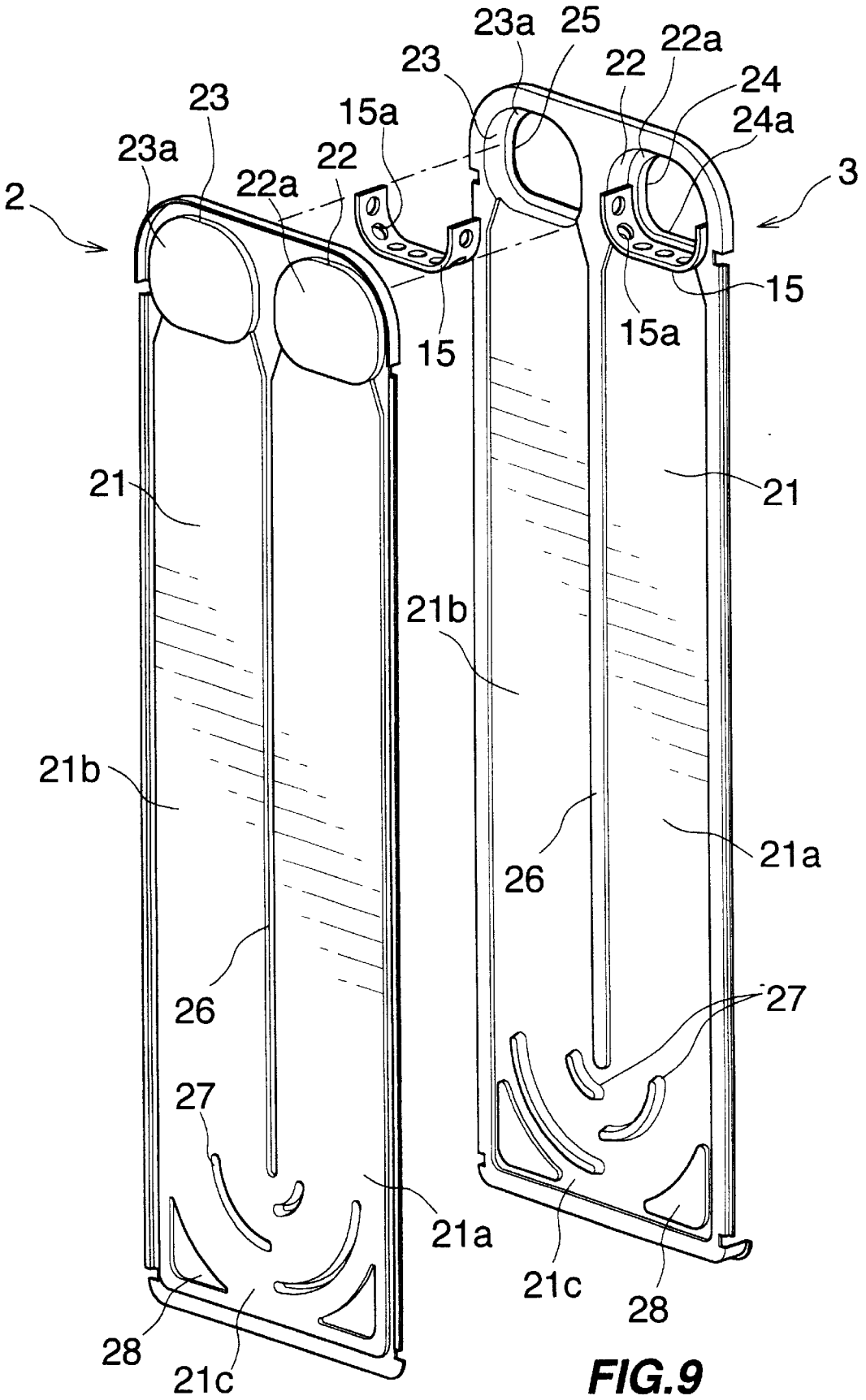
FIG. 9 is a perspective view of an end intermediate plate and a standard intermediate plate paired therewith, these plates constituting the evaporator.

FIG. 9 shows the left end intermediate plate 2 and the standard intermediate plate 3 paired therewith. With reference to the drawing, the left end plate 2 has front and rear header forming recessed portions 22, 23 which are formed in their bottom walls 22*a*, 23*a* with no refrigerant aperture. Two U-shaped reinforcing plates 15 are provided between, and fitted to, each of the left and right end intermediate plates 2 and the standard intermediate plate 3 paired therewith, each of the reinforcing plates 15 being fitted to the lower half of inner periphery of peripheral wall of each recessed portion 22 (23). The reinforcing plate 15 has a width equal to the depth of the recessed portion 22 (23) of the end plate 2 plus the depth of the recessed portion 22 (23) of the standard plate 3. The reinforcing plate 15 is formed with a plurality of refrigerant apertures 15*a* for holding the header portion 6 (7) in communication with the flat tubular portion 5. In the case of the right end intermediate plate 2, the bottom wall 22*a* of the front header forming recessed portion 22 is formed with a through hole serving as a refrigerant outlet 32 and having a diameter equal to the outside diameter of the refrigerant outlet pipe 11, and the bottom wall 23*a* the rear header forming recessed portion 23 is formed with a through hole 30 having a diameter equal to the outside diameter of inner pipe portion 10*a* of the refrigerant inlet pipe 10.

The intermediate plates 2, 3, 3A, 3B, 3C are arranged side by side and fittingly joined to one another, with their recessed portions 21, 22, 23 facing toward opposite directions alternately, whereby the parallel U-shaped flat tubular portions 5 and the front and rear header portions 6, 7 are formed. The front and rear header portions 6, 7 are formed with the respective partitions 12,13 for blocking the refrigerant flowing rightward in the portions 6, 7 and directing the refrigerant toward U-shaped flat tubular portions 5, while the refrigerant dividing wall 14 is formed in the vicinity of the rear header portion 7. The refrigerant inlet pipe 10 extends through the rear header partitioning intermediate plate 3A and has a left end opening which is positioned within the left end portion 7*a* of the rear header portion 7. The inner pipe portion 10*a* of the refrigerant inlet pipe 10 extends through an intermediate portion 7*b* and the right end portion 7*c* of the rear header portion 7, with a refrigerant passing clearance formed in each refrigerant aperture 25 around the pipe portion 10*a*.

The evaporator 1 can be prepared by collectively brazing the components including the reinforcing plates 15 provided between each end intermediate plate 2 and the standard intermediate plate 3 adjacent thereto. The presence of the reinforcing plates 15 gives an improved strength to the evaporator 1 against the internal pressure thereof, making it possible to reduce the wall thickness of the side plates 8 and the inner fin members 29.

Figure 3:
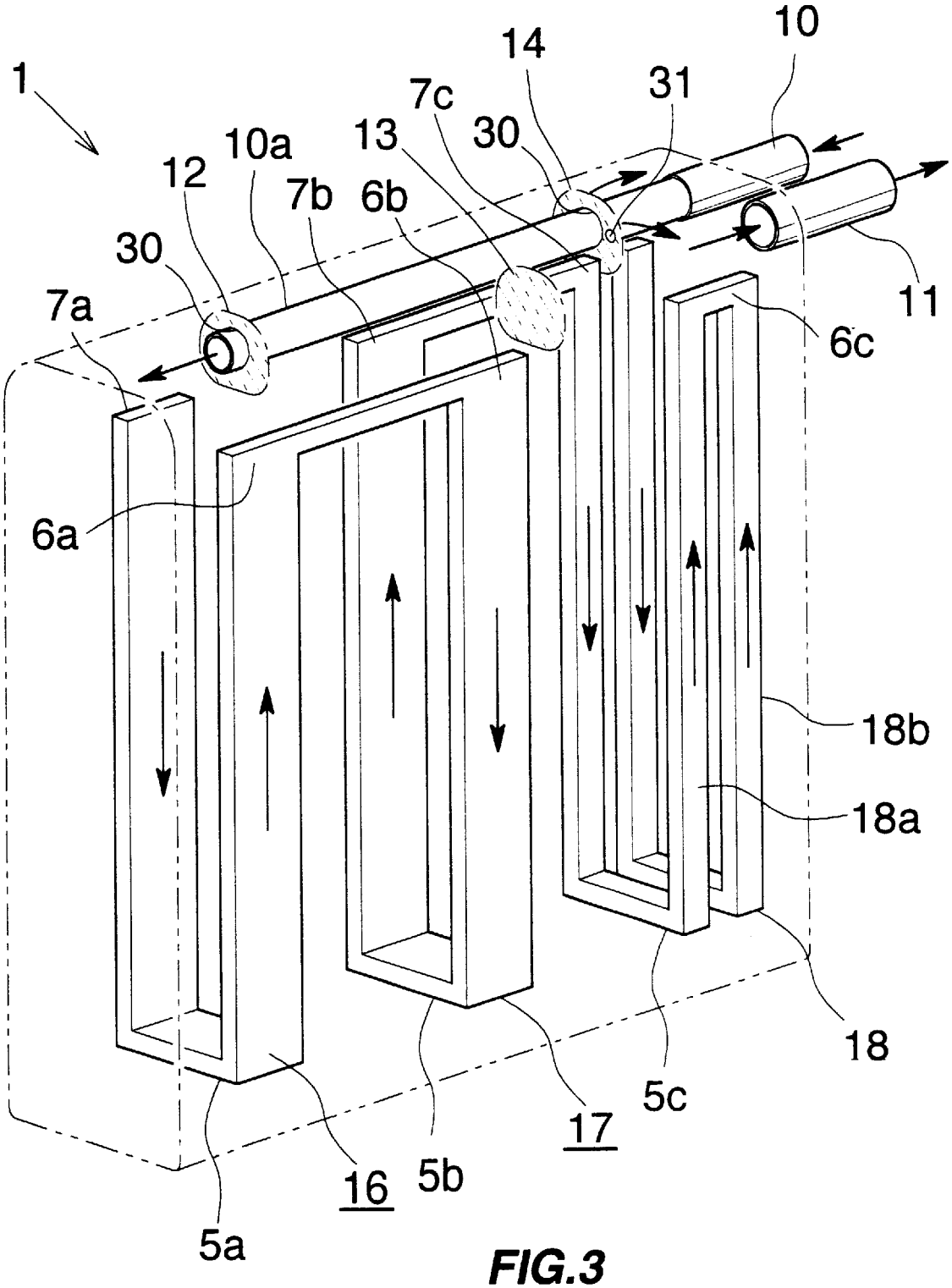
FIG. 3 is a perspective showing a refrigerant channel of the evaporator.

The evaporator 1 thus constructed has in its interior three paths as shown in FIGS. 2 and 3: a first path 16 extending from the left end portion 7*a* of the rear head portion 7 through U-shaped flat tubular portions 5*a* in communication with the portion 7*a* to the left end portion 6*a* of the front header portion 6, an intermediate path 17 extending from an intermediate portion 6*b* of the front header portion 6 through U-shaped flat tubular portions 5*b* in communication with the portion 6*b* to the intermediate portion 7*b* of the rear header portion 7, and a final path 18 extending from the right end portion 7*c* of the rear header portion 7 through U-shaped flat tubular portions 5*c* in communication with the portion 7*c* to the right end portion 6*c* of the front header portion 6. These paths provide a zigzag refrigerant channel 16, 17, 18.

The presence of the refrigerant dividing wall 14 separates the final path 18 into a first branch portion 18*a* and a second branch portion 18*b*, the first branch portion 18*a* extending from flat tubular portions c in the left portion (upstream portion) of the final path 18 to the left portion (upstream portion) of front header 6*c* of the final path 18, the second branch portion 18*b* extending from U-shaped flat tubular portions 5*c* in the right portion (downstream portion) of the final path 18 to the right portion (downstream portion) of front header portion 6*c* of the final path 18.

Accordingly, the refrigerant flowing into the rear header portion 7*c* is divided into a portion flowing through the first branch portion 18*a*, and a portion flowing through the second branch portion 18*b*, and these refrigerant portions join within the front header portion 6*c* to flow out through the outlet pipe 11. When having no refrigerant dividing wall, the evaporator has the problem that an increased quantity of refrigerant flows into flat tubular portion at the right end of the final path, hence a limitation to the improvement of the cooling effect. With the evaporator 1 described, however, the refrigerant dividedly flows into the left part and the right part of the rear header portion 7*c* of the final path 18 and then flows into the individual flat tubular portions 5*c*. This increases the quantity of refrigerant flowing into the flat tubular portions 5*c* at the left of the final path 18, consequently giving a uniform distribution of low refrigerant temperatures throughout the evaporator.

When the evaporator 1 is to be used in a motor vehicle air conditioner, the air passing through the right half of the evaporator is sent, for example, toward the driver's seat, and the air passing through the left half thereof toward the passenger's seat. The temperature of the air to be sent out is approximately equal at left and right even in this case, obviating the likelihood that for example, the passenger's seat will be cooled to excess, with the driver's seat cooled insufficiently, namely, the likelihood of imbalance occurring between opposite sides of the motor vehicle.

Figure 10:
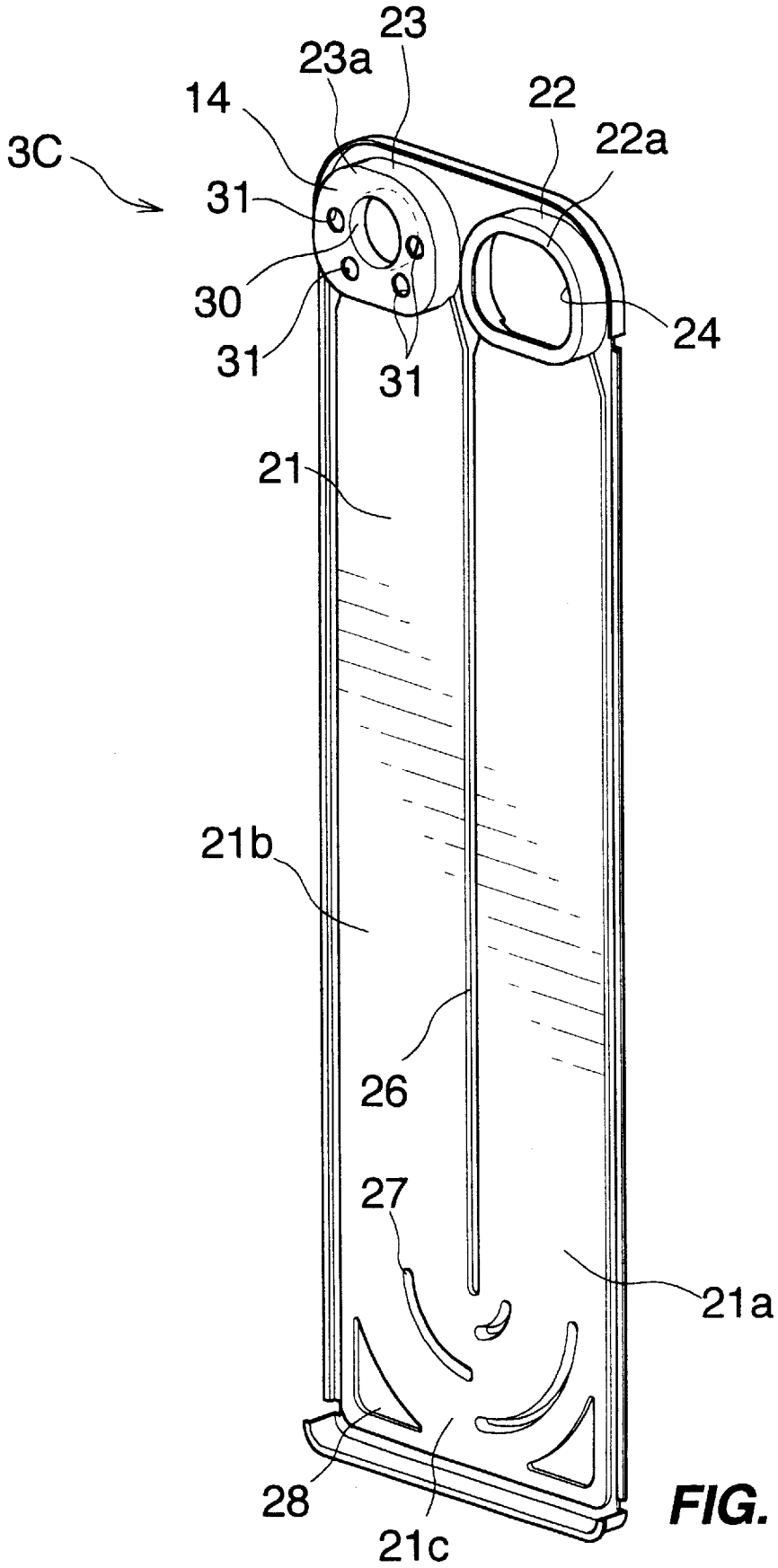
FIG. 10 is a perspective view showing another embodiment of the refrigerant dividing wall forming intermediate plate shown in FIG. 8.

Although the embodiment described has one refrigerant dividing wall forming intermediate plate 3C, at least two plates of this type may be used. The refrigerant dividing wall 14 has two refrigerant apertures 31, whereas this is not limitative. FIG. 10 shows another preferred embodiment of refrigerant dividing wall forming intermediate plate 3C. The plate 3C shown in the drawing has two refrigerant apertures 31 formed at each of the front and rear sides of the through hole 30 in the front header forming recessed portion 23. The refrigerant apertures 31 are arranged at the front and rear sides symmetrically with respect to a vertical axis. The refrigerant apertures 31 are preferably up to six in number. It is desired that the apertures be in one to three pairs, with each pair arranged symmetrically with respect to a vertical axis. Further the refrigerant apertures 31 are preferably 2.5 to 4.0 mm, more preferably 3.0 to 3.5 mm, in diameter. The path provided with the refrigerant dividing wall 14 is not limited to the final path 18; the wall may be provided in the path immediately preceding the final path or in each of these paths. Briefly stated, the refrigerant dividing wall can be modified variously in construction insofar as the wall partly blocks the refrigerant in one path and partly deflects the refrigerant toward flat tubular portions to thereby increase the quantity of refrigerant to be passed through the flat tubular portions in the upstream portion of that path.

Although the partitions 13, 12 are provided respectively in the front and rear header portions 6, 7, one in each header portion, two partitions can be provided in each of the front and rear header portions 6, 7 to provide five paths.

The refrigerant inlet pipe 10 has the inner pipe portion 10*a* according to the foregoing embodiment, whereas the inner pipe portion can be omitted. In this case, the refrigerant inlet pipe is connected to the left end of the rear header portion 7, and the through holes 30 in the rear header partitioning plate 3A and the refrigerant dividing wall forming plate 3C for inserting the inner pipe portion 10*a* are closed.

Although the present invention is applied to an evaporator of the vertical type wherein flat tubular portions are arranged side by side as positioned vertically according to the foregoing embodiment, the invention is similarly applicable also to an evaporator of the horizontal type wherein flat tubular portions are arranged in parallel as positioned horizontally. The front, rear and the left, right in the above embodiment are determined for the sake of convenience; the front-rear or the left-right relationship can of course be reversed.

The type of evaporator is not limited to the single-tank layered evaporator but the invention is useful for evaporators which comprise a pair of header portions 7, 6 arranged in parallel, and flat tubular portions 5 arranged side by side and each connected at its opposite ends to the header portions 7, 6, the header portions 7, 6 being provided with respective partitions 12, 13 for blocking the refrigerant flowing through the portions 7, 6 and directing the refrigerant toward flat tubular portions 5 to thereby form a refrigerant channel comprising a first path 16, at least one intermediate path 17 and a final path 18. At least one of the header portions 7, 6 is then provided with a refrigerant dividing wall 14 having refrigerant apertures 31 for passing therethrough a portion of the refrigerant flowing from the upstream path 16, 17 into the downstream path 17, 18 while blocking the remaining portion of the refrigerant for deflection toward flat tubular portions 5*c*. As compared with an evaporator having no refrigerant dividing wall, an increased amount of refrigerant then flows into the flat tubular portions in the upstream portion of the final path. The evaporator thus adapted has a uniform distribution of refrigerant temperatures in its entirety to exhibit an improved cooling capacity.

When the invention is to be applied, for example, to a two-tank layered evaporators, an upper header portion is provided by the rear header portion 7 of the above embodiment, and a lower header portion by the front header portion 6 of the embodiment, whereby an evaporator is readily available which has the same advantage as described above.

What is claimed is:

1. An evaporator comprising first and second header portions arranged in parallel, and flat tubular portions arranged in parallel and each connected at opposite ends thereof to the header portions, each of the header portions being provided with a partition for blocking a refrigerant flowing inside thereof and directing the refrigerant toward some of the flat tubular portions to thereby form a refrigerant channel comprising a first path, at least one intermediate path and a final path, the evaporator being characterized in that a refrigerant inlet pipe has an inner pipe portion inside the header portion and the header portion, having the inner pipe portion, is provided with at least one refrigerant dividing wall having at least one refrigerant aperture for passing therethrough a portion of the refrigerant flowing from one of the paths into the path downstream from said one path, with the remaining portion of the refrigerant blocked by the wall and directed toward some of the flat tubular portions.

2. An evaporator according to claim 1 wherein the final path causes the refrigerant to turn at a closed end of the first header portion and to flow out of an end of the second header portion which end has a refrigerant outlet, and the refrigerant dividing wall is singly provided in the first header portion of the final path.

3. An evaporator according to claim 2 wherein a refrigerant inlet pipe has an inner pipe portion inside the header portion.

4. An evaporator according to claim 1 wherein one to six refrigerant apertures are formed.

5. An evaporator according to claim 4 wherein the refrigerant apertures are arranged in a plurality of pairs, and each pair of refrigerant apertures are positioned symmetrically.

6. An evaporator according to claim 5 wherein the refrigerant apertures are circular and have a diameter of 2.5 to 4.0 mm.

7. An evaporator according to claim 6 wherein the diameter of the refrigerant apertures is 3.0 to 3.5 mm.

8. An evaporator according to claim 1, wherein the evaporator has a plurality of plates including at least one refrigerant dividing wall forming intermediate plate, and the refrigerant dividing wall forming intermediate plate has a flat tube forming recessed portion and front and rear header forming recessed portions, the header forming recessed portion of the header portion having the inner pipe portion formed in its bottom wall with a through hole having a diameter equal to the outside diameter of the inner pipe portion of the refrigerant inlet pipe.

* * * * *